US009352554B2

(12) United States Patent
Goto

(10) Patent No.: US 9,352,554 B2
(45) Date of Patent: May 31, 2016

(54) IMAGE PROCESSING METHOD AND IMAGE PROCESSING APPARATUS

(71) Applicant: CANON KABUSHIKI KAISHA, Tokyo (JP)

(72) Inventor: Ryohei Goto, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/700,126

(22) Filed: Apr. 29, 2015

(65) Prior Publication Data

US 2015/0314590 A1 Nov. 5, 2015

(30) Foreign Application Priority Data

May 1, 2014 (JP) ..... 2014-094626

(51) Int. Cl.

| | |
|---|---|
| ***B41J 2/01*** | (2006.01) |
| ***B41M 5/00*** | (2006.01) |
| ***B41J 2/005*** | (2006.01) |
| ***B41M 5/025*** | (2006.01) |

(52) U.S. Cl.

CPC *B41J 2/0057* (2013.01); *B41J 2/01* (2013.01); *B41M 5/0017* (2013.01); *B41M 5/0256* (2013.01); *B41J 2002/012* (2013.01)

(58) Field of Classification Search

CPC ..... B41J 2/0057; B41J 2002/012; B41J 2/01; B41M 5/0017; B41M 5/0256

USPC ..... 347/103

See application file for complete search history.

(56) References Cited

U.S. PATENT DOCUMENTS

| | | | | |
|---|---|---|---|---|
| 4,538,156 | A | 8/1985 | Durkee | |
| 5,099,256 | A | 3/1992 | Anderson | |
| 2005/0110856 | A1* | 5/2005 | Mouri | B41J 2/0057 347/103 |
| 2009/0085960 | A1* | 4/2009 | Yahiro | B41J 2/2114 347/21 |
| 2013/0250021 | A1 | 9/2013 | Shimomura | |

FOREIGN PATENT DOCUMENTS

| | | | |
|---|---|---|---|
| JP | S62-092849 | A | 4/1987 |
| JP | 4834300 | B2 | 12/2011 |

* cited by examiner

*Primary Examiner* — Stephen Meier
*Assistant Examiner* — Alexander D Shenderov
(74) *Attorney, Agent, or Firm* — Canon U.S.A., Inc., IP Division

(57) ABSTRACT

An image recording method includes applying a reaction liquid onto an intermediate transfer member, applying an ink onto the reaction liquid on the intermediate transfer member, forming an intermediate image by applying a liquid composition containing a water-soluble polymer onto the reaction liquid and the ink on the intermediate transfer member, and transferring the intermediate image by bringing the intermediate image on the intermediate transfer member into contact with a recording medium and separating the intermediate image from the intermediate transfer member with the contact with the recording medium maintained. The intermediate image to be brought into contact with the recording medium has a temperature Tc higher than or equal to the glass transition temperature of the water-soluble polymer, and the intermediate image to be separated from the intermediate transfer member has a temperature Tr lower than the glass transition temperature of the water-soluble polymer.

10 Claims, 3 Drawing Sheets

IMAGE PROCESSING METHOD AND IMAGE PROCESSING APPARATUS

BACKGROUND OF THE INVENTION

1. Field of the Invention

The present application relates to an image recording method and an image recording apparatus.

2. Description of the Related Art

Ink jet recording apparatuses are widely used as output equipment in the field of computers because of their low running cost, capability of size reduction, and ease of recording color image with a plurality of color inks. In recent years, an image recording apparatus has been desired which can output high-quality images at a high seed independently of the type of the recording medium. In order to achieve high-speed, high-quality image output, it is important to reduce image degradation phenomena, such as feathering that is a phenomenon in which ink spreads along the fibers of the recording medium.

From the viewpoint of overcoming the issue, U.S. Pat. Nos. 4,538,156 and 5,099,256 and Japanese Patent Laid-Open No. 62-92849 disclose transfer image recording apparatuses using an intermediate transfer member. These transfer image recording apparatuses form an intermediate image on an intermediate transfer member using an ink jet recording device. The intermediate image on the intermediate transfer member is dried and then transferred to a recording medium as a final image. Since the intermediate image is dried on the intermediate transfer member, the image recording method using such a transfer technique does not cause feathering, which is a disadvantageous phenomenon caused in high-speed, high-quality image output operation.

In the transfer image recording method, however, the intermediate image may be partially left on the intermediate transfer member without being transferred to the recording medium, or may be divided therein in such a manner that the divided parts are separately transferred to the recording medium or the intermediate transfer member. Thus the transfer image recording method cannot satisfactorily form images in some cases.

From the view point of overcoming this disadvantage, Japanese Patent No. 4834300 discloses a method in which a second material containing a water-soluble polymer is applied to a previously formed intermediate image. In this method, a first material capable of aggregating pigment particles in an ink is first applied onto the intermediate transfer member, and then the ink is applied onto the intermediate transfer member, to which the first material has been applied, from a recording head, thus forming an intermediate image on the intermediate transfer member. Then, a second material containing a water-soluble polymer is applied to the intermediate transfer member, and subsequently the intermediate image on the intermediate transfer member is transferred to a recording medium. The first material contains a metal salt.

SUMMARY OF THE INVENTION

According to an aspect of the present application, an image recording method is provided which includes the steps of applying a reaction liquid onto an intermediate transfer member, applying an ink onto the reaction liquid on the intermediate transfer member, forming an intermediate image by applying a liquid composition containing a water-soluble polymer onto the reaction liquid and the ink on the intermediate transfer member, and transferring the intermediate image from the intermediate transfer member to a recording medium by bringing the intermediate image into contact with the recording medium and separating the intermediate image from the intermediate transfer member with the contact with the recording medium maintained. In the step of transferring, the intermediate image to be brought into contact with the recording medium has a temperature Tc higher than or equal to the glass transition temperature of the water-soluble polymer, and the intermediate image to be separated from the intermediate transfer member has a temperature Tr lower than the glass transition temperature of the water-soluble polymer.

According to another aspect of the present application, an image recording apparatus is provided which includes a reaction liquid application device capable of applying a reaction liquid onto an intermediate transfer member, an ink application device capable of applying an ink onto the reaction liquid on the intermediate transfer member, a liquid composition application device capable of applying a liquid composition forming an intermediate image by applying a liquid composition containing a water-soluble polymer onto the reaction liquid and the ink on the intermediate transfer member, and a transferring device configured to transfer the intermediate image by bringing the intermediate image on the intermediate transfer member into contact with the recording medium and separating the intermediate image from the intermediate transfer member with the contact with the recording medium maintained, and an intermediate image temperature controller configured to control the temperature of the intermediate image to a temperature Tc higher than or equal to the glass transition temperature of the water-soluble polymer, and to control the temperature of the intermediate image to a temperature Tr lower than the glass transition temperature of the water-soluble polymer.

Further features of the present invention will become apparent from the following description of exemplary embodiments with reference to the attached drawings.

DESCRIPTION OF THE EMBODIMENTS

Figure 1:
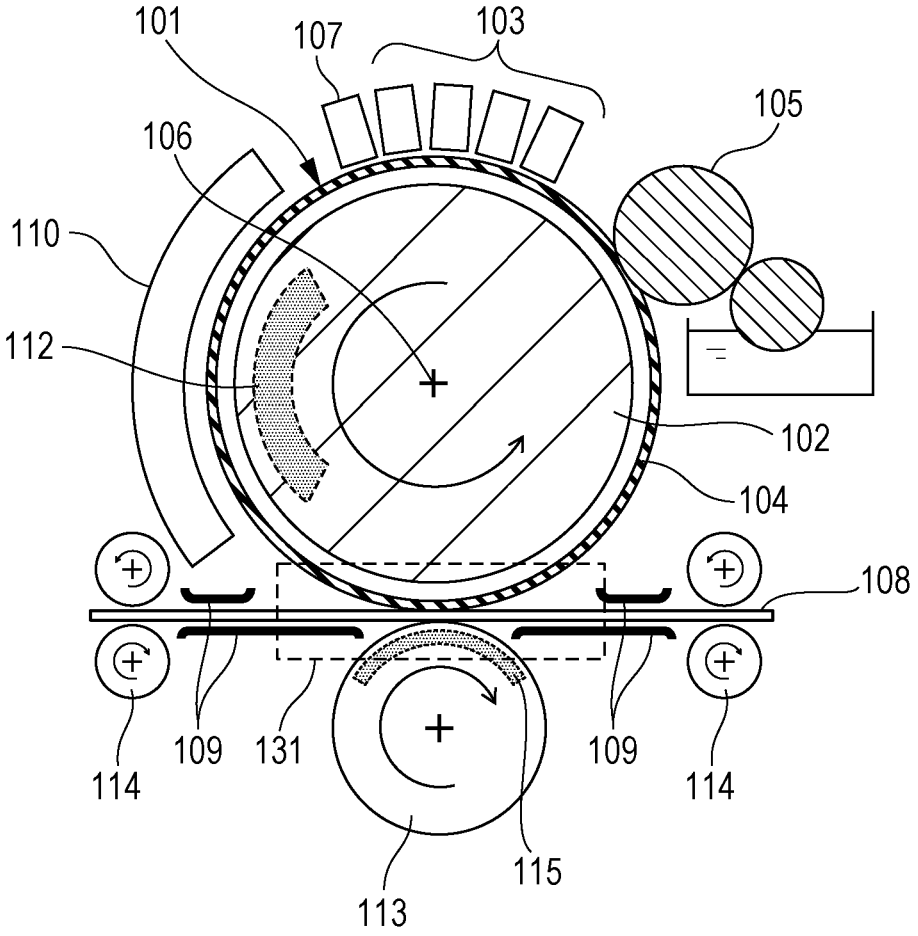
FIG. 1 is a schematic view of an image recording apparatus according to an embodiment.

In the known arts including those disclosed in the above-cited patent documents, a second material containing a water-soluble polymer is used mainly for improving the transferability of the intermediate image to the recording medium and for improving the rub fastness of the intermediate image. Also, it is desirable to improve the transferability of the intermediate image to the recording medium in terms of the relationship between the material of the intermediate image and temperature in transfer operation. The present application is intended to improve the transfer efficiency of the intermediate image to the recording medium and thus to produce high-quality images.

1. Image Recording Apparatus

The image recording apparatus according to an embodiment includes a reaction liquid application device, an ink application device, a liquid composition application device, a temperature controller, and a transferring device. The reaction liquid application device applies a reaction liquid onto an intermediate transfer member. The ink application device applies an ink onto the reaction liquid on the intermediate transfer member. The liquid composition application device applies a liquid composition containing a water-soluble polymer onto the reaction liquid and the ink on the intermediate transfer member. The transferring device is capable of transferring the intermediate image to a recording medium. Furthermore, the temperature controller controls the temperature of the intermediate image as follows:

controlling the intermediate image to a temperature Tc higher than or equal to the glass transition temperature Tg of the water-soluble polymer in the liquid composition when the intermediate image comes into contact with recording medium; and controlling the intermediate image to a temperature Tr lower than the glass transition temperature Tg of the water-soluble polymer when the intermediate image is separated from the intermediate transfer member with the contact with the recording medium maintained.

The temperature controller is a device capable of controlling the temperature(s) of the intermediate transfer member, the recording medium, and/or the transferring device so that the temperature of the intermediate image can be controlled to Tc and Tr satisfying Tc≥glass transition temperature Tg of the water-soluble polymer>Tr, and is not otherwise limited. For example, the temperature controller controls the temperature of the intermediate image depending on the glass transition temperature of the water-soluble polymer by appropriately combing the operations of heating the intermediate image from the direction(s) of the intermediate transfer member and/or the recording medium and cooling the intermediate image from the direction(s) of the intermediate transfer member and/or the recording medium.

In the image recording apparatus of the present embodiment, the intermediate image is set to the temperature Tc when being transferred. Consequently, the fluidity of the intermediate image has been increased at the time when the intermediate image comes in contact with the recording medium, and thus the adhesion between the recording medium and the intermediate image is increased. Also, the intermediate image is set to the temperature Tr when being transferred. Consequently, the intermediate image is rapidly cooled after coming in contact with the recording medium, so that the water-soluble polymer turns into a glass state, thereby suppressing the separation at the interface between the intermediate image and the recording medium. Thus, the transfer efficiency of the intermediate image to the recording medium is improved, and accordingly high-quality images can be formed.

FIG. 1 is a schematic view of an image recording apparatus according to an embodiment. The image recording apparatus shown in FIG. 1 includes an intermediate transfer member including a rotatable support member 102 in the form of a drum and a surface member 104 disposed over the periphery of the support member 102. The support member 102 is rotated on the axis 106 in the direction indicated by the arrow, and devices arranged around the intermediate transfer member are operated in synchronization with the rotation.

The image recording apparatus is also provided with a roller coating device 105 as a reaction liquid application device that applies the reaction liquid to the outer surface of the intermediate transfer member 101. The roller coating device 105 is configured to deliver the reaction liquid in a reaction liquid vessel by the rotation of two rollers, using the peripheries of the rollers. The reaction liquid on the peripheries of the rollers is applied to the outer surface of the intermediate transfer member 101 by the rotation of the roller in contact with the outer surface of the intermediate transfer member 101.

Ink jet devices 103 and 107 are disposed downstream from the roller coating device 105 in the rotation direction of the intermediate transfer member 101 so as to oppose the outer surface of the intermediate transfer member 101. Ink jet devices (ink application devices) 103 apply inks to the outer surface of the intermediate transfer member 101, and ink jet device (liquid composition application device) 107 applies the liquid composition to the outer surface of the intermediate transfer member 101. The ink jet devices 103 and 107 are each of a type that ejects ink on demand, using an electrothermal conversion element. These ink jet devices are of a line head type in which ink jet heads are aligned in a direction substantially parallel to the axis 106 of the intermediate transfer member 101. Thus the reaction liquid, inks and the liquid composition are applied in that order onto the outer surface of the intermediate transfer member 101, thereby forming an intermediate image (mirror-reversed image) of these liquids. A blower 110 is disposed to reduce the liquid content from the intermediate image on the intermediate transfer member 101. Thus, the liquid content in the intermediate image is reduced to prevent the disruption of the image during transfer for forming a satisfactory image.

The support member 102 of the intermediate transfer member 101 contains a heater (temperature controller) 112. The heater 112 heats the intermediate transfer member to a temperature higher than or equal to the glass transition temperature of the water-soluble polymer contained in the liquid composition by the time of transferring the intermediate image. A pressure roller 113 having an outer surface opposing the outer surface of the intermediate transfer member 101 is disposed more downstream in the rotation direction of the intermediate transfer member 101. The intermediate transfer member 101 and the pressure roller 113 thus constitute a transferring device. The pressure roller 113 brings the intermediate image on the intermediate transfer member 101 into contact with the recording medium 108, thereby transferring the intermediate image to the recording medium 108. The pressure roller 113 contains a cooler (temperature controller) 115. The cooler 115 reduces temperature for transfer to a level lower than the glass transition temperature of the water-soluble polymer. In the apparatus shown in FIG. 1, a pressure is applied for efficiently transferring the intermediate image by pinching the recording medium 108 and the intermediate image on the intermediate transfer member 101 between the intermediate transfer member 101 and the pressure roller 113. In a transfer step in practice, the intermediate image on the intermediate transfer member 101 comes into contact in an image transferring region 131 with a recording medium 108 conveyed along a conveyance guide 109 by the rotation of conveying rollers 114. The intermediate transfer member 101 is then removed, and the intermediate image is thus transferred to the recording medium 108.

In the present embodiment, the intermediate image is separated from the intermediate transfer member 101 with the contact with the recording medium 108 maintained. For controlling the temperature of the intermediate image at this time, the cooler or the temperature controller 115 is used. The temperature control when the intermediate image is separated is however not limited to this manner. In another embodiment, the intermediate image may be cooled by dissipating heat from the intermediate image in the transferring device.

Advantageously, the recording medium and the transferring device are selected so that the intermediate image having a temperature Tc (≥glass transition temperature Tg of the water-soluble polymer) can be cooled to Tr (<Tg) in the period from when the intermediate image is conveyed to the transferring device to when it is separated from the intermediate transfer member 101. If the intermediate image is cooled by heat dissipation and the recording medium 108 is fed to the transferring device at room temperature (for example, 25° C.), the temperature of the intermediate image is reduced to Tr mainly by the heat absorption of the recording medium 108 from the intermediate image. Although the temperature controller, in this instance, only heats the intermediate transfer member, any structure may be taken as long as the temperature of the intermediate image can be controlled to temperatures of Tc and Tr satisfying Tc Tg of the water-soluble polymer>Tr. The intermediate image on the intermediate transfer member is heated by the heater 112 heating the intermediate transfer member. This may enable the liquid component in the intermediate image to be removed. In this instance, the temperature of the intermediate image is increased to Tc by heating with the heater 112 the surface of the intermediate transfer member 101 having the intermediate image thereon. On the other hand, the recording medium 108 to be fed to the pressure roller 113 has a temperature equal to room temperature (25° C.)

The recording medium 108 is printing paper and, for example, may be coated paper or matte paper. The recording medium 108 may be a sheet cut into a prescribed shape, or a rolled long sheet.

In the apparatus shown in FIG. 1, the temperature of the intermediate transfer member 101 in the image transferring region 131 (first temperature) is controlled to a temperature higher than or equal to the glass transition temperature of the water-soluble polymer in the intermediate image. On the other hand, the temperature of the recording medium 108 has a temperature lower than the glass transition temperature of the water-soluble polymer. Consequently, when the intermediate image is transferred in the image transferring region 131, the adhesion between the intermediate image and the recording medium 108 is increased to higher than the adhesion between the intermediate image and the intermediate transfer member 101, so that the intermediate image is efficiently transferred to the recording medium 108.

Figure 2:
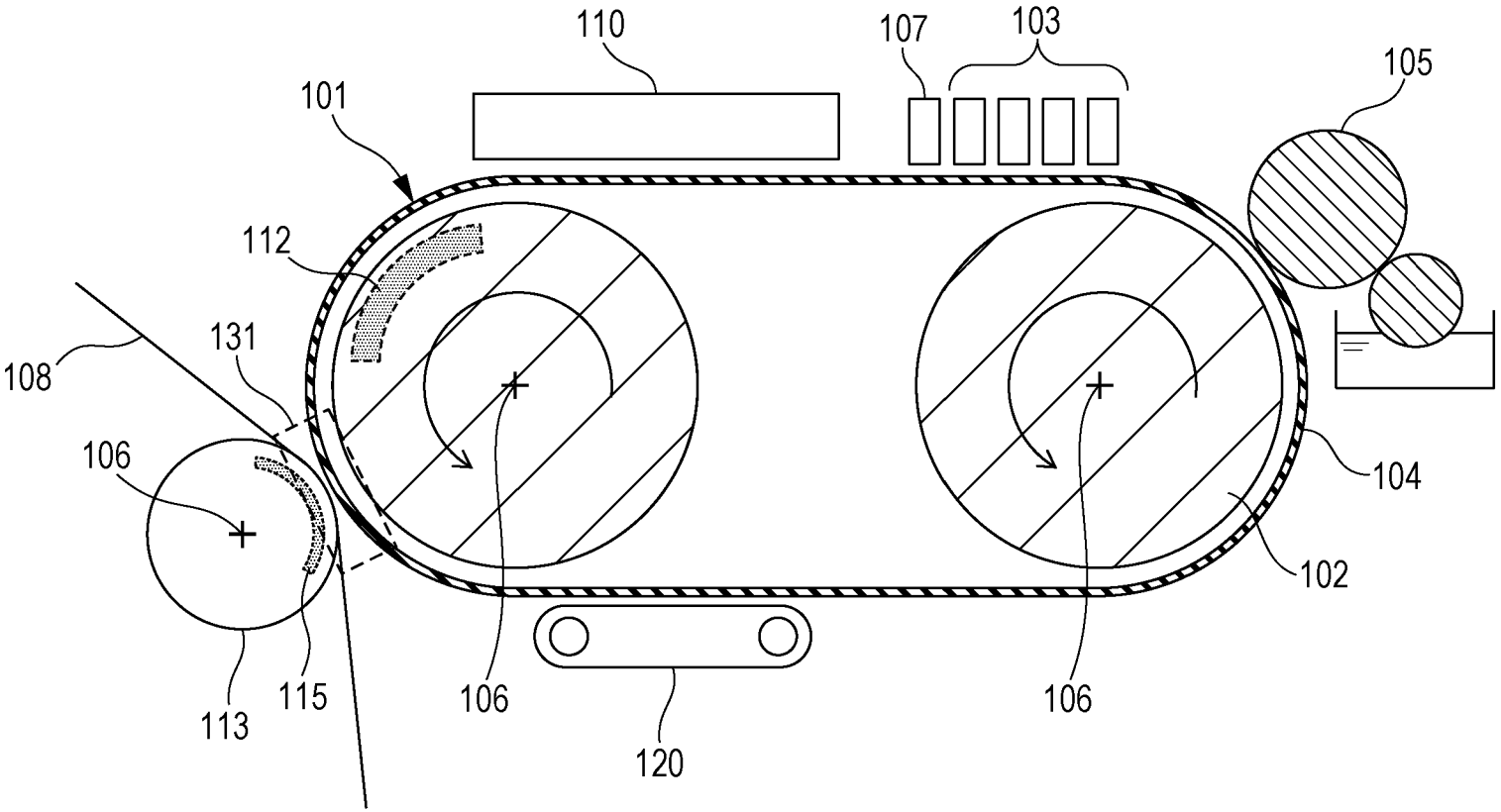
FIG. 2 is a schematic view of an image recording apparatus according to another embodiment.

FIG. 2 shows an image recording apparatus according to another embodiment which is different from the image recording apparatus shown in FIG. 1 in that an intermediate transfer member 101 in the form of a belt and a conveying belt (or fixing belt) 120 are used.

Figure 3:
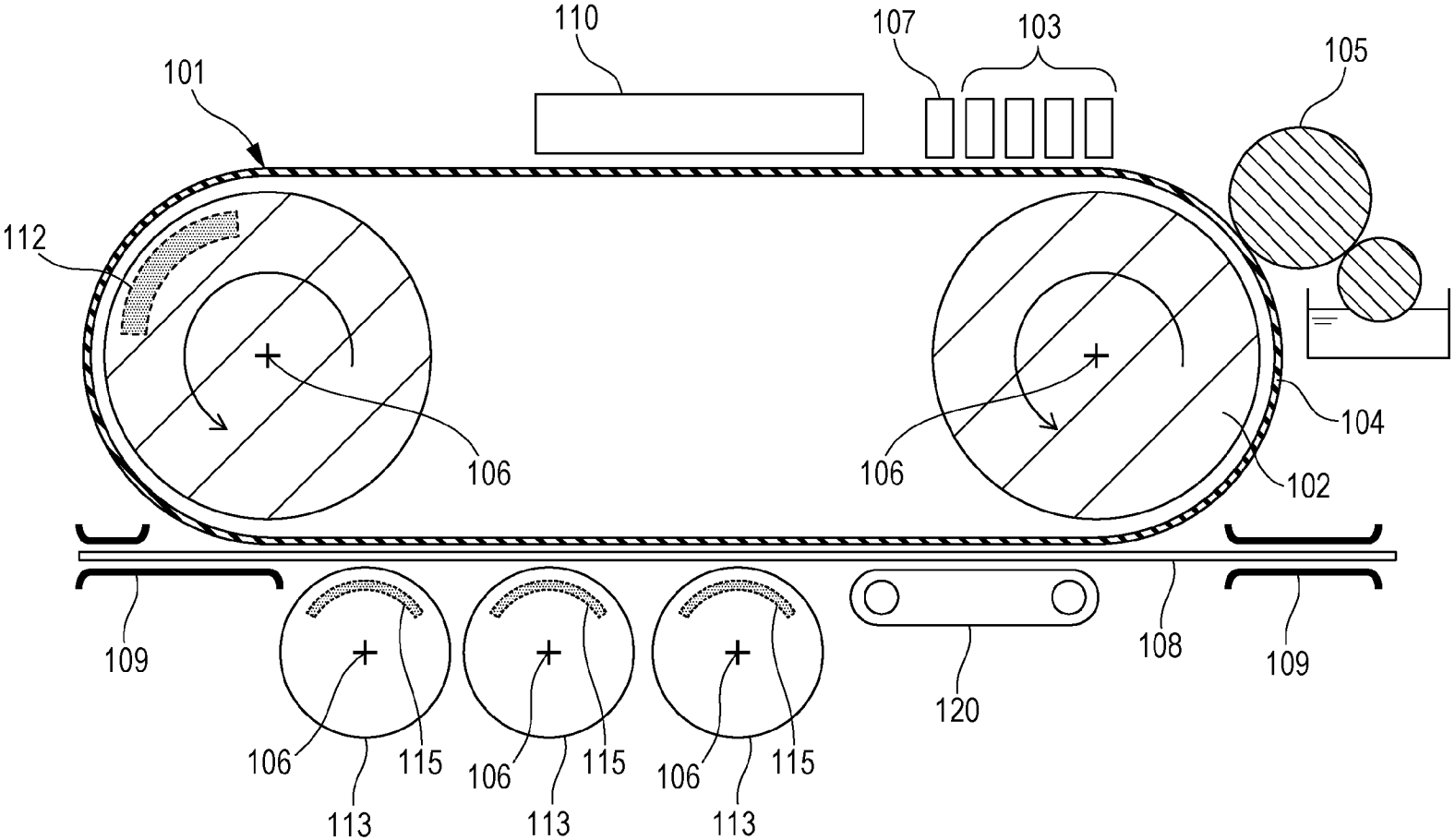
FIG. 3 is a schematic view of an image recording apparatus according to still another embodiment.

FIG. 3 shows an image recording apparatus according to still another embodiment. The image recording apparatus shown in FIG. 3 is different from the image recording apparatus shown in FIG. 1 in that an intermediate transfer member 101 in the form of a belt, a conveying belt (or fixing belt) 120 and a plurality of pressure rollers 113 are provided therein. The components or members other than these members in the image recording apparatuses shown in FIGS. 2 and 3 are the same as those of the image recording apparatus of FIG. 1, and thus description thereof will be omitted.

The temperatures Tc and Tr satisfying Tc≥Tg of the water-soluble polymer>Tr are not otherwise limited. Tc may be in the range of 50° C. to 140° C., and Tr may be in the range of 25° C. to 70° C.

The members or components of the image recording apparatus of an embodiment will be further described in detail.

Intermediate Transfer Member

The intermediate transfer member acts as the substrate on which the reaction liquid, the ink and the liquid composition are held to form an intermediate image. The intermediate transfer member may include a support member adapted to handle the intermediate transfer member and transmit required power, and a surface member disposed on the support member and on which images are formed. The support member and the surface member may be defined by a single member in one body, or may be defined by their respective members.

The support member may be in the shape of a sheet, a roller, a drum, a belt, or an endless web. The support member in a drum shape or a belt-like endless web shape enables continuous and repetitive use of one intermediate transfer member. This is very advantageous in terms of productivity. The size of the intermediate transfer member may be selected depending on the size of the image to be printed. The support member of the intermediate transfer member is required to have a strength to some extent from the viewpoint of conveyance accuracy and durability. Suitable materials of the support member include metals, ceramics and polymers. Among these materials, advantageous are aluminum, iron, stainless steel, acetal polymer, epoxy polymer, polyimide, polyethylene, polyethylene terephthalate, nylon, polyurethane, silica ceramics, and alumina ceramics. These materials are suitable in view of the rigidity of the support member against pressure applied for transfer and the dimensional accuracy, and suitable to reduce the inertia in operation to improve control response. Two or more of these materials may be used in combination. In an embodiment using the apparatus shown in FIG. 1, it is advantageous that the support member 102 allows the intermediate image to have the above-described temperature history.

Since the surface member of the intermediate transfer member is used for transferring an image to a recording medium such as paper by pressing the image on the recording medium, the surface member is desirably elastic to some extent. For example, when paper is used as the recording medium, the surface member of the intermediate transfer member desirably has a type A durometer hardness (specified in JIS•K 6253) in the range of 10° to 100°, such as in the range of 20° to 60°. Also, the surface member may be made of any material, such as polymer, ceramic, or metal. In an embodiment, a rubber or an elastomer may be used from the viewpoint of characteristics and workability. Examples of the material of the surface member include polybutadiene rubber, nitrile rubber, chloroprene rubber, silicone rubber, fluorocarbon rubber, urethane rubber, styrene elastomers, olefin elastomers, vinyl chloride elastomers, ester elastomers, and amide elastomers. The surface member may be made of other materials such as polyether, polyester, polystyrene, polycarbonate, siloxane compounds, and perfluorocarbon compounds. Nitrile-butadiene rubber, silicone rubber, fluorocarbon rubber and urethane rubber are particularly advantageous because of the dimensional stability, durability, heat resistance and other properties thereof.

The surface member may have a multilayer structure including layers of different materials. Examples of such a multilayer structure include a urethane rubber endless belt coated with silicone rubber, a sheet of PET film coated with a silicone rubber, and a urethane rubber sheet covered with a film of a siloxane compound. A sheet may be used which is made of a woven base cloth of cotton, polyester, rayon or the like, impregnated with a rubber material such as nitrile-butadiene rubber or urethane rubber. The surface member may be subjected to an appropriate surface treatment. Examples of such surface treatment include frame treatment, corona treatment, plasma treatment, polishing, roughening, active energy ray (UV, IR, RF, etc.) irradiation, ozonization, surfactant treatment, and silane coupling. A plurality of surface treatment operations may be performed in combination. The surface member and the support member may be fixed or held by an adhesive or a double-side adhesive tape disposed therebetween.

Reaction Liquid

The reaction liquid contains an ink viscosity-increasing material. "Ink viscosity-increasing" mentioned herein may imply that the coloring material, polymer or any other constituent in the ink comes in contact with the ink viscosity-increasing material and reacts with or physically adsorbs to the ink viscosity-increasing material to increase the viscosity of the ink as a whole. It may also imply that the viscosity of the ink is locally increased by aggregation of one or some of the constituents in the ink, such as the coloring material. The use of the ink viscosity-increasing material can reduce the fluidity of the ink on the intermediate transfer member or a constituent of the ink, thereby suppressing bleeding and beading caused when images are formed. The content of the ink viscosity-increasing material in the reaction liquid can be set depending on the type thereof, the conditions of the application of the reaction liquid to the intermediate transfer member, the type of the ink, and so forth. For example, the ink viscosity-increasing material may be selected from among known materials including polyvalent metal ions, organic acids, cationic polymers, and porous particles, without particular limitation. Polyvalent metal ions and organic acids are particularly advantageous. One or more of these ink viscosity-increasing materials may be used in combination.

The content of the ink viscosity-increasing material in the reaction liquid is desirably 5% by mass or more relative to the total mass of the reaction liquid. More specifically, metal ions that can be used as the ink viscosity-increasing material include divalent metal ions and trivalent metal ions. Examples of divalent metal ions include $Ca^{2+}$, $Cu^{2+}$, $Ni^{2+}$, $Mg^{2+}$, $Sr^{2+}$, $Ba^{2+}$, and $Zn^{2+}$, and examples of trivalent metal ions include $Fe^{3+}$, $Cr^{3+}$, $Y^{3+}$, and $Al^{3+}$. Examples of organic acids that can be used as the ink viscosity-increasing material include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidonecarboxylic acid, pyronecarboxylic acid, pyrrolecarboxylic acid, furancarboxylic acid, pyridinecarboxylic acid, coumalic acid, thiophenecarboxylic acid, nicotinic acid, oxysuccinic acid, and dioxysuccinic acid.

The reaction liquid may contain an appropriate amount of water or organic solvent. The water is desirably deionized by ion-exchange. The organic solvent that may be used in the reaction liquid is not particularly limited, and can be selected from known organic solvents. The reaction liquid may contain a polymer. The addition of an appropriate polymer to the reaction liquid is advantageous in increasing the adhesion between the intermediate image being transferred and the recording medium and in increasing the mechanical strength of the final image. Any polymer may be added without particular limitation as long as it can coexist with the ink viscosity-increasing material. The reaction liquid may further contain a surfactant or a viscosity modifier to control the surface tension or the viscosity, if necessary. Any surfactant or viscosity modifier may be used as long as it can coexist with the ink viscosity-increasing material. For example, Acetylenol E 100 (produced by Kawaken Fine Chemicals) may be used as the surfactant.

Ink

The constituents of the ink used in an embodiment will be described below.

(a) Coloring Material

The ink may contain a pigment as a coloring material. The pigment may be dispersed in a liquid and used in the form of liquid dispersion. The pigment can be selected from among known inorganic pigments and organic pigments without particular limitation. More specifically, pigments designated by color index (C.I.) numbers can be used. A carbon black may be used as a black pigment. The pigment content in the ink may be in the range of 0.5% by mass to 15.0% by mass, such as in the range of 1.0% by mass to 10.0% by mass, relative to the total mass of the ink.

(b) Pigment Dispersant

A pigment dispersant may be used for dispersing the pigment. The pigment dispersant can be selected from among known materials used in the ink jet technology. Among the known pigment dispersant materials, a water-soluble dispersant having a molecular structure having both a hydrophilic site and a hydrophobic site is advantageous. A pigment dispersant is particularly advantageous which contains a polymer produced by copolymerizing a hydrophilic monomer and a hydrophobic monomer. The monomers are not particularly limited, and any known monomers can be used. Examples of the hydrophobic monomer include styrene, styrene derivatives, alkyl(meta)acrylates, and benzyl(meta)acrylate. Examples of the hydrophilic monomer include acrylic acid, methacrylic acid, and maleic acid.

The pigment dispersant may have an acid value in the range of 50 mg KOH/g to 550 mg KOH/g. The weight average molecular weight of the pigment dispersant may be in the range of 1,000 to 50,000. The mass ratio of the pigment to the pigment dispersant may be in the range of 1:0.1 to 1:3. A self-dispersible pigment that has been surface-modified so as to be dispersible in the ink may be used without using a dispersant.

(c) Polymer Particles

The ink may further contain polymer particles other than the coloring material. Some types of polymer particles have the effect of improving image quality and adhesion, and such polymer particles are advantageous. The material of the polymer particles can be selected from among known polymers without particular limitation. Exemplary materials include polyolefin, polystyrene, polyurethane, polyester, polyether, polyurea, polyamide, polyvinyl alcohol, poly(meta)acrylic acids and salts thereof, polyalkyl(meta)acrylates, and homopolymers or copolymers of polydiens or the like. The weight average molecular weight of the polymer particles may be in the range of 1,000 to 2,000,000. The content of the polymer particles in the ink may be in the range of 1% by mass to 50% by mass, such as in the range of 2% by mass to 40% by mass, relative to the total mass of the ink.

In an embodiment, the polymer particles may be used in the form of a polymer particle dispersion in which the polymer particles are dispersed in a solvent. The polymer particles may be dispersed by any process. For example, particles of a homopolymer or copolymer of one or more monomers having a dissociable group are dispersed, and a thus prepared dispersion of self-dispersible polymer particles is advantageously used. Exemplary dissociable groups include carboxy, sulfo and phosphate groups, and monomers having such a dissociable group include acrylic acid and methacrylic acid.

Alternatively, an emulsifier-dispersed polymer particle dispersion may be used which is prepared by dispersing polymer particles with an emulsifier. A known surfactant may be used as the emulsifier irrespective of whether the polymer particles have a low molecular weight or a high molecular weight. A nonionic surfactant or a surfactant having the same charge as the polymer particles is advantageous as the surfactant. The polymer particles in the polymer particle dispersion may have a particle size in the range of 10 nm to 1000 nm, such as 100 nm to 500 nm. For preparing the polymer particle dispersion, some additives may be added to stabilize the dispersion. Examples of the additives include n-hexadecane, dodecyl methacrylate, stearyl methacrylate, chlorobenzene, dodecyl mercaptan, olive oil, blue dye (Blue 70), and polymethyl methacrylate.

(d) Surfactant

The ink may contain a surfactant. The surfactant may be Acetylenol EH (produced by Kawaken Fine Chemicals). The surfactant content in the ink may be in the range of 0.01% by mass to 5.0% by mass relative to the total mass of the ink.

(e) Water and Water-Soluble Organic Solvent

The ink may also contain water and/or a water-soluble organic solvent as the solvent. The water is desirably deionized by ion-exchange. The water content in the ink may be in the range of 30% by mass to 97% by mass relative to the total mass of the ink. The water-soluble organic solvent is not particularly limited and any known organic solvent may be used. Examples of the water-soluble organic solvent include glycerol, diethylene glycol, polyethylene glycol, and 2-pyrrolidone. The content of the water-soluble organic solvent in the ink may be in the range of 3% by mass to 70% by mass relative to the total mass of the ink.

(f) Other Additives

The ink may further contain other additives, such as a pH adjuster, a rust preventive, a preservative, a fungicide, an antioxidant, an antireductant, a water-soluble polymer and its neutralizer, and a viscosity modifier, as needed.

Liquid Composition

A liquid composition containing a water-soluble polymer that will act as a binder in the image is applied onto the intermediate transfer member. Thus, the adhesion of the intermediate image with the recording medium is increased, accordingly increasing the rub fastness (fixability) of the final image formed by transferring the intermediate image to the recording medium. The liquid composition may be soluble or insoluble in water, and contains a water-soluble polymer. The water-soluble polymer used herein is a compound having a solubility of more than 0 g in 100 g of water.

Any water-soluble polymer can be used in the liquid composition as long as it can act as a binder in the image. It is however advantageous to select a water-soluble polymer suitable to the liquid composition application device. For example, if a recording head is used as the liquid composition application device, a water-soluble polymer having a weight average molecular weight in the range of 2000 to 10000, such as in the range of 5000 to 10000, may be advantageously used. If a roller coater is used as the liquid composition application device, a water-soluble polymer having a higher weight average molecular weight than above may be used. The water-soluble polymer may have a glass transition temperature (Tg) in the range of 40° C. to 120° C.

Examples of the water-soluble polymer include block copolymers, random copolymers and graft copolymer, or salts thereof, synthesized from at least two monomers (at least one of the monomers is a polymerizable hydrophilic monomer) selected from the group consisting of styrene (Tg=100° C.), styrene derivatives, vinyl naphthalene (Tg=159° C.), vinyl naphthalene derivatives, aliphatic alcohol esters of α,β-ethylenic unsaturated carboxylic acids, acrylic acid, acrylic acid derivatives, maleic acid, maleic acid derivatives, itaconic acid, itaconic acid derivatives, fumaric acid, fumaric acid derivatives, vinyl acetate, vinyl alcohols, vinyl pyrrolidone, acrylamide, and derivatives thereof. Among these, advantageous are block or random copolymers synthesized from at least two monomers (at least one of the monomers is a polymerizable hydrophilic monomer) selected from the group consisting of styrene, acrylic acid, acrylic acid derivatives, methacrylic acid, and methacrylic acid derivatives. Natural polymers such as rosin, shellac, and starch are also advantageous. These water-soluble polymers are soluble in alkaline solutions prepared by dissolving a base in water.

The water-soluble polymer content in the liquid composition may be in the range of 0.1% by mass to 20% by mass, such as in the range of 0.1% by mass to 10% by mass, relative to the total mass of the liquid composition. Desirably, the liquid composition has a lower surface tension than the ink. Such a liquid composition can spread over the intermediate transfer member and accordingly come easily in contact with the ink. The liquid composition may contain polymer particles. The polymer particles may be the same as the polymer particles contained in the ink. The use of such a liquid composition suppresses the migration of the ink on the intermediate transfer member or increases the fastness of the image on the recording medium. The liquid composition may be applied onto the intermediate image in a proportion in the range of 0.1 to 50, such as in the range of 0.5 to 25, relative to the amount of the ink applied onto the intermediate transfer member.

2. Image Recording Method

In an image recording method according to an embodiment, the reaction liquid is applied onto an intermediate transfer member, and then the ink is applied onto the reaction liquid on the intermediate transfer member. Then, an intermediate image is formed by applying the liquid composition containing a water-soluble polymer onto the reaction liquid and the ink on the intermediate transfer member. Subsequently, the intermediate image is transferred to a recording medium under the conditions where the first temperature of the intermediate transfer member is controlled to a temperature higher than or equal to the glass transition temperature of the water-soluble polymer and the second temperature of the recording medium is controlled to a temperature lower than the glass transition temperature of the water-soluble polymer.

In the image recording method of the present embodiment, the first temperature of the intermediate transfer member when the intermediate image is transferred is controlled to a temperature higher than or equal to the glass transition temperature of the water-soluble polymer in the intermediate image. Consequently, the fluidity of the intermediate image is increased at the time when the intermediate image comes in contact with the recording medium, and thus the adhesion between the recording medium and the intermediate image is increased. Also, in the image recording method, the second temperature of the recording medium when the intermediate image is transferred is controlled to a temperature lower than the glass transition temperature of the water-soluble polymer in the intermediate image. Consequently, the intermediate image is rapidly cooled after coming in contact with the recording medium, so that the water-soluble polymer turns into a glass state, thereby suppressing the separation at the interface between the intermediate image and the recording medium. Thus, the transfer efficiency of the intermediate image to the recording medium is improved, and accordingly high-quality images are formed.

When the first temperature is controlled as above, it takes a certain time to heat the intermediate image to the same temperature as the first temperature by heat conduction from the intermediate transfer member to the intermediate image. In the present embodiment, however, the temperature of the intermediate image is allowed to reach the same temperature as the first temperature by the time of the transfer operation (when the intermediate image comes into contact with the recording medium) by, for example, heating the intermediate transfer member before the transfer operation. Also, when the intermediate image, which is very thin, comes into contact with the recording medium with the second temperature for being transferred, the heat of the intermediate image is conducted to the recording medium in a very short time. At this time, the temperature of the recording medium is not increased. It is assumed that the intermediate image thus comes to a temperature lower than the glass transition temperature Tg of the water-soluble polymer when transferred (when separated from the intermediate transfer member). Thus, the temperature of the intermediate image when transferred (when separated from the intermediate transfer member) can come to the same temperature as the second temperature of the recording medium. In the present embodiment, since the intermediate image is very thin, it is assumed that the heat conduction speed in the intermediate image does not determine the speed of the temperature change of the intermediate image. It is therefore not taken into account that heat conduction from the intermediate transfer member to the intermediate image and from the intermediate image to the recording medium takes a long time and gives the intermediate image a temperature gradient.

In the description herein and appended claims, the term intermediate image refers to an image formed on the intermediate transfer member using the reaction liquid, the ink and the liquid composition.

The first temperature refers to the temperature of the intermediate transfer member when the intermediate image is transferred (in the period of time from when the intermediate image comes into contact with the recording medium to the time immediately before the intermediate image separates from the intermediate transfer member).

The second temperature refers to the temperature of the recording medium when the intermediate image is transferred (when the intermediate image separates from the intermediate transfer member with the contact with the recording medium maintained).

The first and second temperatures can be checked by measuring the surface temperatures of the intermediate transfer member and the recording medium with an infrared radiation thermometer before and after being pressed with the pressure roller. Alternatively, the changes in surface temperature of the intermediate transfer member during conveyance, from heating with the heater 112 to pressure application with the pressure roller 113 in the apparatus shown in FIG. 1, may be estimated. Also, the changes in surface temperatures of the intermediate transfer member and the recording medium when pressure roller 113 presses the surface of the intermediate transfer member with the recording medium 108 therebetween are measured in advance. The apparatus shown in FIG. 1 is selected and operated so the first and second temperatures satisfy the above-described relationship with the glass transition temperature of the water-soluble polymer. Thus the first and second temperatures can be appropriately controlled.

The temperature of the intermediate image can also be checked by measuring the surface temperatures of the intermediate image with an infrared radiation thermometer before and after being pressed with the pressure roller. Thus, the intermediate image can be controlled to temperatures Tc and Tr by appropriately selecting and controlling the apparatus shown in FIG. 1.

The glass transition temperature of the water-soluble polymer is measured with a differential scanning calorimeter (for example, DSC822e manufactured by Mettler Toledo). More specifically, for example, the glass transition temperature is estimated by applying the temperature cycle from 30° C. to 120° C. at a heating rate of 2° C./min twice to 10 mg of the water-soluble polymer in an aluminum crucible in a nitrogen atmosphere (at a flow rate of 20 mL/min).

The first temperature is controlled to a temperature higher than the second temperature and higher than or equal to the glass transition temperature of the water-soluble polymer, and is not otherwise limited. Advantageously, the difference between the first temperature and the second temperature is in the range of 10° C. to 35° C.

The image recording method of an embodiment will now be described in detail.

Application of Reaction Liquid

The application of the reaction liquid to the surface of the intermediate transfer member may be performed by a method appropriately selected from among the known methods. For example, the reaction liquid may be applied by die coating, blade coating, use of a gravure roller, use of an offset roller, or spray coating. Alternatively, the reaction liquid may be applied using an ink jet device. Some of these methods may be combined.

Application of Ink

Subsequently, the ink is applied onto the reaction liquid on the intermediate transfer member. The application of the ink may be performed by any method without particular limitation. For example, the ink may be applied using an ink jet device. The ink jet device can be selected from among the types that:

ejects ink by film-boiling the ink by electrothermal conversion for bubbling:

ejects ink by electromechanical conversion; and ejects ink by static electricity.

Other ink jet devices used for ink jet liquid ejection techniques may be used. Particularly from the viewpoint of high-speed, high-density printing, the electrothermal conversion type is advantageous.

The structure of the ink jet device is not particularly limited. For example, the ink jet device may be what is called a shuttle ink jet head that moves for recording in a direction perpendicular to the movement of the intermediate transfer member. Alternatively, the ink jet device may be what is called a line head having ink ejection openings aligned in a line in a direction substantially perpendicular to the movement of the intermediate transfer member (for a drum-shaped transfer medium, in a direction substantially parallel to the axis direction).

Although the properties of the ink are not particularly limited as long as the advantage of the invention is adversely affected, the surface tension of the ink is desirably in the range of 20 mN/m to 50 mN/m.

Application of Liquid Composition

Then, the liquid composition containing a water-soluble polymer is applied onto the reaction liquid and the ink on the intermediate transfer member. The application of the liquid composition may be performed by any method without particular limitation. For example, the liquid composition may be applied using an ink jet device. Thus an intermediate image is formed from the reaction liquid, the ink and the liquid composition on the intermediate transfer member.

Although the properties of the liquid composition are not particularly limited as long as the advantage of the invention is adversely affected, the surface tension of the liquid composition is desirably in the range of 20 mN/m to 50 mN/m.

Removal of Liquid Component

In an embodiment, the liquid component in the intermediate image on the intermediate transfer member may be removed in a step of the image recording method. This operation of removing excess liquid component prevents the excess liquid component in the intermediate image from leaching out and thus helps form a satisfactory final image. For removing the liquid component, any of the known methods may be applied. For example, the liquid component may be removed by heating the intermediate image, blowing low-humidity air on the intermediate image, reducing pressure, bringing an absorber into contact with the intermediate image, or a combination of these methods. Natural drying may also be applied. If the liquid component is removed by heating, the intermediate transfer member can be heated to a temperature higher than or equal to the glass transition temperature of the water-soluble polymer by this heating. In this instance, the heater used for removing the liquid component may double as the temperature controller.

Transfer of Intermediate Image

In the step of transfer, the intermediate image is transferred to a recording medium under the conditions where the first temperature of the intermediate transfer member is controlled to a temperature higher than or equal to the glass transition temperature of the water-soluble polymer and the second temperature of the recording medium is controlled to a temperature lower than the glass transition temperature of the water-soluble polymer. It is not particularly limited how the intermediate image is transferred. For example, the intermediate image may be transferred from the intermediate transfer member to the recording medium by pressing the intermediate transfer member and the recording medium on each other. It is not particularly limited how the intermediate transfer member and the recording medium are pressed on each other. For example, it may be effective to use a pressure roller disposed in contact with the outer surface of the intermediate transfer member in such a manner that the recording medium is passed between the intermediate transfer member and the pressure roller. Thus the intermediate image is pressed from both sides in the direction of the intermediate transfer member and the direction of the recording medium, so that the intermediate image can be efficiently transferred. Alternatively, the pressing for transfer is performed in a plurality of stages, as shown in FIG. 3. This is effective in reducing transfer failure. In this instance, the apparatus has a multistep arrangement in which the intermediate image comes to Tr in the final stage of separating the intermediate image from the intermediate transfer member.

In order to control the temperature of the recording medium during transfer, the pressure roller may contain a heater. The heater may be disposed so as to heat a part of the pressure roller, but desirably disposed so as to heat the entirety of the pressure roller. In the step of transfer, the first temperature is controlled to a temperature higher than or equal to the glass transition temperature of the water-soluble polymer, and the second temperature is controlled to a temperature lower than the glass transition temperature of the water-soluble polymer. Accordingly, the temperature of the pressure roller is desirably variable within the range of variation in the second temperature according to the type of the water-soluble polymer. Desirably, the heater is configured to heat the surface of the pressure roller from 25° C. to 140° C. The recording medium may be conveyed for transfer at a speed in the range of 0.1 m/s to 3 m/s, and the nip pressure between the pressure roller and the intermediate transfer member may be in the range of 5 kg/cm$^2$ to 30 kg/cm$^2$.

Fixing

The recording medium to which the image has been transferred may be pressed with a roller to firmly fix the final image to the recording medium. Heating the recording medium may also be effective in increasing the fixability of the final image. Pressing and heating may simultaneously be performed using a heating roller.

EXAMPLES

The Examples of the present application will now be described in detail with reference to the drawings. The scope of the application is not limited to the following Examples. In the following description, "part(s)" and "%" are on a mass basis unless otherwise specified.

Example 1

Image recording was performed using the image recording apparatus shown in FIG. 1. In the present Example, a cylindrical member made of an aluminum alloy was used as the support member 102 of the intermediate transfer member in view of required properties including dimensional accuracy and a rigidity sufficiently resistant to the pressure for transfer, and from the viewpoint of reducing the inertia in rotation to improve the response to control. For forming the surface member 104 was used a 0.5 mm thick PET sheet coated with a 0.2 mm thick film of silicone rubber having a rubber hardness of 40° (KE 12 manufactured by Shin-Etsu Chemical). The surface member was subjected to plasma surface treatment with an atmospheric plasma apparatus (ST-7000 manufactured by Keyence) in a high plasma mode under the conditions: a treatment distance of 5 mm; and a treatment rate of 100 mm/sec. This surface was soaked in an aqueous solution of a neutral detergent for 10 seconds for treatment. The neutral detergent aqueous solution was prepared by dissolving in pure water 3% of neutral detergent containing sodium alkylbenzenesulfonate. The surface was subsequently dried, and thus the surface member 104 was produced. The resulting surface member 104 was fixed to the support member 102 with a two-sided adhesive tape. In the present Example, OK Prince High Quality Paper (127.9 g/m$^2$, manufacture by Oji Paper) was used as the recording medium.

The reaction liquid, the ink and the liquid composition used in the apparatus of FIG. 1 were prepared as below.

Preparation of Reaction Liquid

The reaction liquid was prepared by mixing 30 parts of glutaric acid, 7 parts of glycerol, 5 parts of a surfactant (Acetylenol E 100) and 58 parts of ion exchanged water, sufficiently stirring the mixture, and then filtering the mixture with a pressure through a microfilter of 3.0 μm in pore size (produced by Fujifilm Corporation).

Preparation of Black Pigment Dispersion Liquid

First, 10 parts of carbon black (product name: Monarch 1100, produced by Cabot), 15 parts of pigment dispersant aqueous solution (containing styrene-ethyl acrylate-acrylic acid copolymer (acid value: 150, weight average molecular weight: 8,000) with a solid content of 20%) neutralized with potassium hydroxide, and 75 parts of pure water were mixed. The resulting mixture was placed in a batch-type vertical sand mill (manufacture by Aimex), and then 200 parts of zirconia beads of 0.3 mm in diameter were placed in the sand mill. The materials in the mixture were thus dispersed with cooling for 5 hours. The resulting dispersion liquid was centrifuged to remove coarse particles, and thus a black pigment dispersion liquid containing about 10% of black pigment was prepared.

Preparation of Polymer Particle Dispersion

The mixture of 18 parts of ethyl methacrylate, 2 parts of 2,2'-azobis-(2-methylbutyronitrile), and 2 parts of n-hexadecane was stirred for 0.5 hour. The mixture was dropped to 78 parts of 6% aqueous solution of NIKKOL BC 15 (emulsifier, produced by Nikko Chemicals), followed by stirring for 0.5 hour. Then, the resulting mixture was subjected to supersonic wave irradiation for 3 hours. Subsequently, the mixture was subjected to a polymerization reaction for 4 hours in a nitrogen atmosphere at 80° C., followed by cooling at room temperature. The reaction product was filtered to yield a dispersion containing about 20% of polymer particles.

Preparation of Ink

The mixture of 5 parts of the black pigment dispersion liquid, 30 parts of the polymer particle dispersion, 5 parts of glycerol, 4 parts of diethylene glycol, 1 part of a surfactant (Acetylenol EH), and 55 parts of ion exchanged water was sufficiently stirred. Then, the mixture was subjected to pressure filtration through a microfilter of 3.0 μm in pore size (produced by Fujifilm Corporation) to yield an ink (surface tension: 35 mN/m). The surface tension of the ink was measured with an automatic surface tensiometer (DY-300, manufactured by Kyowa Interface Science).

Preparation of Liquid Composition

The mixture of 30 parts of the polymer particle dispersion, 3 parts of a water-soluble polymer (styrene-butyl acrylate-acrylic acid copolymer (acid value: 132, weight average molecular weight: 7,700, glass transition temperature: 78° C.) with a solid content of 20% neutralized with an aqueous solution of potassium hydroxide), 5 parts of glycerol, 4 parts of diethylene glycol, 1 part of a surfactant (Acetylenol EH), and 57 parts of ion exchanged water was sufficiently stirred. Then, the mixture was subjected to pressure filtration through a microfilter of 3.0 μm in pore size (produced by Fujifilm Corporation) to yield a liquid composition (surface tension: 35 mN/m). The surface tension of the liquid composition was measured with an automatic surface tensiometer (DY-300, manufactured by Kyowa Interface Science). The glass transition temperature of the water-soluble polymer was measured with a differential scanning calorimeter (manufactured by Mettler Toledo).

In the present Example, image recording was performed as below using the apparatus shown in FIG. 1. First, the reaction liquid was applied onto the intermediate transfer member 101 from the roller coating device 105. Then, the ink and liquid composition prepared above were applied onto the intermediate transfer member 101 from the ink jet devices 103 and 107, respectively, thereby forming an intermediate image. Subsequently, the liquid component was removed from the intermediate image on the intermediate transfer member 101 with the blower 110 while the intermediate transfer member 101 was heated with the heater 112 in the intermediate transfer member 101. Subsequently, with the rotation of the intermediate transfer member 101 in the direction of the arrow, the intermediate image was brought into contact with the recording medium 108 between the intermediate transfer member 101 and the pressure roller 113 in the image transferring region 131, thus being transferred to the recording medium 108 from the intermediate transfer member 101. In the present Example, for this transfer operation, the first temperature of the intermediate transfer member 101 was set to 80° C., and the second temperature of the recording medium 108 was set to 25° C. The temperatures of the intermediate transfer member 101 and the recording medium 108 were measured with an infrared radiation thermometer.

Example 2

Image recording was performed in the same manner as in Example 1, except that a liquid composition containing a water-soluble polymer (benzyl methacrylate-butyl methacrylate-acrylic acid copolymer) having an acid value of 84, a weight average molecular weight of 7,100, and a glass transition temperature of 44° C. was used.

Example 3

Image recording was performed in the same manner as in Example 1, except that a liquid composition containing a water-soluble polymer (styrene-butyl methacrylate-acrylic acid copolymer) having an acid value of 87, a weight average molecular weight of 9,300, and a glass transition temperature of 60° C. was used and that the first temperature of the intermediate transfer member 101 was 70° C. and the second temperature of the recording medium 108 was 40° C.

Example 4

Image recording was performed in the same manner as in Example 1, except that the glutaric acid (30 parts) in the reaction liquid was substituted with citric acid (30 parts).

Example 5

Image recording was performed in the same manner as in Example 1, except that the glutaric acid (30 parts) in the reaction liquid was substituted with levulinic acid (30 parts).

Example 6

Image recording was performed in the same manner as in Example 1, except that an ink not containing polymer particles was used.

Example 7

Image recording was performed in the same manner as in Example 1 using the apparatus shown in FIG. 1, except that the temperatures of the intermediate transfer member 101 and the recording medium 108 were set to 80° C. and 75° C.

Example 8

Image recording was performed in the same manner as in Example 1 using the apparatus shown in FIG. 1, except that the temperatures of the intermediate transfer member 101 and the recording medium 108 were set to 80° C. and 70° C., respectively.

Example 9

Image recording was performed in the same manner as in Example 1 using the apparatus shown in FIG. 1, except that the temperatures of the intermediate transfer member 101 and the recording medium 108 were set to 110° C. and 75° C., respectively.

Example 10

Image recording was performed in the same manner as in Example 1 using the apparatus shown in FIG. 1, except that the temperatures of the intermediate transfer member 101 and the recording medium 108 were set to 80° C. and 25° C., respectively.

Example 11

Image recording was performed in the same manner as in Example 1, except that a liquid composition not containing polymer particles was used.

Example 12

Image recording was performed in the same manner as in Example 1, except that the surfactant (Acetylenol EH) content and the ion exchanged water content in the liquid composition were varied to 5 parts and 53 parts, respectively, to vary the surface tension thereof to 30 mN/m.

Comparative Example 1

A recording apparatus not provided with the ink jet device 107 for ejecting the liquid composition was used. Hence, the liquid composition was not applied onto the intermediate transfer member 101. Also, the temperature of the intermediate transfer member 101 was set to 80° C., and the temperature of the recording medium 108 was set to 25° C. Except for these, image recording was performed in the same manner as in Example 1.

Comparative Example 2

Image recording was performed in the same manner as in Example 1 using the apparatus shown in FIG. 1, except that the temperatures of the intermediate transfer member 101 and the recording medium 108 were set to 50° C., which is a temperature lower than the glass transition temperature of the water-soluble polymer, and 25° C., respectively.

Measurement of Percentage of Transfer

In Examples 1 to 12, temperatures were controlled to Tc and Tr satisfying the relationship Tc glass transition temperature (Tg) of the water-soluble polymer in the liquid composition>Tr. On the other hand, in Comparative Examples 1 and 2, this relationship did not hold true.

The percentage of transfer was estimated for each image recording performed under such conditions. The percentage of transfer of the intermediate image to the recording medium was calculated using the ratio of the area of the intermediate image remaining on the intermediate transfer member after transfer to the area of the intermediate image on the intermediate transfer member before transfer. More specifically, the area of the remaining intermediate image was measured by observing the intermediate transfer member after transfer through an optical microscope, and the percentage of transfer was calculated using the equation: {1−(area of the remaining intermediate image)/(area of the intermediate image)}×100.

The Table shows the first temperature of the intermediate transfer member and the percentage of transfer in the Examples and Comparative Examples. As shown in the Table, the percentages of transfer in Examples 1 to 12 were as high as 90% or more. On the other hand, Comparative Example 1, which did not use the liquid composition, exhibited low transferability. Comparative Example 2, in which the first temperature of the intermediate transfer member was lower than the glass transition temperature of the water-soluble polymer, exhibited low transferability. These results suggest show that the method according to an embodiment of the application allows image recording with high transferability.

TABLE

| Example No. | Reactant in reaction liquid | Surface tension of ink (mN/m) | Surface tension of liquid composition (mN/m) | Presence of polymer particles in ink | Presence of polymer particles in liquid composition | Glass transition temperature Tg (° C.) of water-soluble polymer | First temperature T1 (° C.) | Second temperature T2 (° C.) | T1 − T2 (° C.) | Percentage of transfer (%) |
|---|---|---|---|---|---|---|---|---|---|---|
| Example 1 | Glutaric acid | 35 | 35 | Yes | Yes | 78 | 80 | 25 | 55 | 93 |
| Example 2 | Glutaric acid | 35 | 35 | Yes | Yes | 44 | 80 | 25 | 55 | 93 |
| Example 3 | Glutaric acid | 35 | 35 | Yes | Yes | 60 | 70 | 40 | 30 | 98 |
| Example 4 | Citric acid | 35 | 35 | Yes | Yes | 78 | 80 | 25 | 55 | 93 |
| Example 5 | Levulinic acid | 35 | 35 | Yes | Yes | 78 | 80 | 25 | 55 | 93 |
| Example 6 | Glutaric acid | 35 | 35 | No | Yes | 78 | 80 | 25 | 55 | 93 |
| Example 7 | Glutaric acid | 35 | 35 | Yes | Yes | 78 | 80 | 75 | 5 | 93 |
| Example 8 | Glutaric acid | 35 | 35 | Yes | Yes | 78 | 80 | 70 | 10 | 98 |
| Example 9 | Glutaric acid | 35 | 35 | Yes | Yes | 78 | 110 | 75 | 35 | 98 |
| Example 10 | Glutaric acid | 35 | 35 | Yes | Yes | 78 | 80 | 35 | 45 | 93 |
| Example 11 | Glutaric acid | 35 | 35 | Yes | No | 78 | 80 | 25 | 55 | 93 |
| Example 12 | Glutaric acid | 35 | 30 | Yes | Yes | 78 | 80 | 25 | 55 | 97 |
| Comparative Example 1 | Glutaric acid | 35 | 35 | Yes | Yes | — | 80 | 25 | 55 | 34 |
| Comparative Example 2 | Glutaric acid | 35 | 35 | Yes | Yes | 78 | 50 | 25 | 25 | 87 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-094626, filed May 1, 2014, which is hereby incorporated by reference herein in its entirety.

What is claimed is:

1. An image recording method comprising:

applying a reaction liquid onto an intermediate transfer member;

applying an ink onto the reaction liquid on the intermediate transfer member;

forming an intermediate image by applying a liquid composition containing a water-soluble polymer onto the reaction liquid and the ink on the intermediate transfer member; and transferring the intermediate image from the intermediate transfer member to a recording medium by bringing the intermediate image on the intermediate transfer member into contact with the recording medium, and then separating the intermediate image from the intermediate transfer member with the contact with the recording medium maintained, wherein the intermediate image to be brought into contact with the recording medium has a temperature Tc higher than or equal to the glass transition temperature of the water-soluble polymer, and the intermediate image to be separated from the intermediate transfer member has a temperature Tr lower than the glass transition temperature of the water-soluble polymer.

2. The image recording method according to claim 1, wherein the temperatures Tc and Tr have a difference in the range of 10° C. to 35° C.

3. The image recording method according to claim 1, wherein the liquid composition has a surface tension lower than the ink.

4. The image recording method according to claim 1, wherein the liquid composition contains polymer particles.

5. The image recording method according to claim 1, wherein the water-soluble polymer has a weight average molecular weight in the range of 5000 to 10000.

6. The image recording method according to claim 1, wherein the water-soluble polymer is a block copolymer or random copolymer synthesized from at least two monomers selected from a group consisting of styrene, acrylic acid, acrylic acid derivatives, methacrylic acid, and methacrylic acid derivatives, and wherein one of the at least two monomers is a polymerizable hydrophilic monomer.

7. The image recording method according to claim 1, wherein the intermediate image is heated such that the intermediate image is heated to have the temperature Tc when being brought into contact with the recording medium, and is cooled to have the temperature Tr when being separated from the intermediate transfer member.

8. The image recording method according to claim 7, wherein the intermediate image is heated by using a heater.

9. The image recording method according to claim 7, wherein the intermediate image is cooled by using a cooler or dissipating heat from the intermediate image.

10. An image recording apparatus comprising:

a reaction liquid application device capable of applying a reaction liquid onto an intermediate transfer member;

an ink application device capable of applying an ink onto the reaction liquid on the intermediate transfer member;

a liquid composition application device capable of applying a liquid composition containing a water-soluble polymer onto the reaction liquid and the ink on the intermediate transfer member;

a transferring device configured to transfer the intermediate image by bring the intermediate image on the intermediate transfer member into contact with a recording medium and separate the intermediate image from the intermediate transfer member with the contact with the recording medium maintained; and an intermediate image temperature controller configured to control the temperature of the intermediate image to be brought into contact with the recording medium to a temperature Tc higher than or equal to the glass transition temperature of the water-soluble polymer, and to control the temperature of the intermediate image to be separated from the intermediate transfer member to a temperature Tr lower than the glass transition temperature of the water-soluble polymer.

* * * * *